United States Patent [19]

Maure

[11] Patent Number: 4,519,180

[45] Date of Patent: May 28, 1985

[54] WRAPPING MACHINE

[75] Inventor: Jean Maure, Renens, Switzerland

[73] Assignee: Societe Anonyme des Plieuses Automatiques, Switzerland

[21] Appl. No.: 371,237

[22] Filed: Apr. 23, 1982

[30] Foreign Application Priority Data

Jun. 23, 1981 [CH] Switzerland ..... 4132/81

[51] Int. Cl.[3] ..... B65B 11/28

[52] U.S. Cl. ..... 53/234; 198/484

[58] Field of Search ..... 53/225, 234, 579; 74/54, 413; 198/484

[56] References Cited

U.S. PATENT DOCUMENTS

| | | | |
|---|---|---|---|
| 956,623 | 5/1910 | Bracy | 53/579 X |
| 1,413,857 | 3/1922 | Langer | 53/225 |
| 1,530,516 | 3/1925 | Rarig | 198/484 |
| 1,574,120 | 2/1926 | Sergent | 53/234 X |
| 1,674,026 | 6/1928 | Smith et al. | 53/234 X |
| 2,822,652 | 2/1958 | Taggart et al. | 53/225 |
| 2,985,991 | 5/1961 | Habgood | 53/225 X |
| 3,504,476 | 4/1970 | Ehrenfried et al. | 53/234 X |
| 3,628,309 | 12/1971 | Seragnoli | 53/234 |
| 3,834,522 | 9/1974 | Jackson | 198/484 X |
| 3,885,374 | 5/1974 | Schmermund | 53/234 |
| 4,221,287 | 9/1980 | Seragnoli | 53/225 X |

FOREIGN PATENT DOCUMENTS

| | | | |
|---|---|---|---|
| 1425009 | 2/1976 | United Kingdom | 53/234 |
| 524361 | 9/1977 | U.S.S.R. | 53/225 |

*Primary Examiner*—John Sipos
*Assistant Examiner*—Steven P. Weihrouch
*Attorney, Agent, or Firm*—Hayes, Davis & Soloway

[57] ABSTRACT

The apparatus according to the invention consists of a hollow rotating cylinder 10 having openings 14 disposed at regular intervals the length of its peripheral surface. Said cylinder is engaged in stepping rotation by hollow shaft 34. A cylindrical block is situated inside cylinder 10, said cylindrical block being composed of two stationary elements 18 and 19 connected to a stationary tubular piece 26 containing a pivotable shaft 23. The pivotable shaft has a toothed pinion 22 attached to its anterior end, which pinion cooperates with grooved slides 20 and 21, which serve both as the means for ejecting products and as a movable base for the folding cavity once the products has been positioned therein.

4 Claims, 5 Drawing Figures

WRAPPING MACHINE

The present invention concerns a wrapping machine, particularly for products grouped inside a common package, consisting of a device for providing wrapping material, a device for transporting the groups of products, a receptor means disposed to simultaneously receive at least one section of wrapping material of a predetermined length and at least one group of products, a means for transferring said group of products and said section of wrapping material, and an ejector means to eject the products at least partially wrapped in said material.

Machines of this type are already known in the art, described in detail in German Patent Application No. 26 37 398 which has been published prior to examination. These machines, which are, for example, designed for wrapping a group of stacked candies, sticks or round pieces of chewing gum, consist of one or more rotating devices called revolving folding devices. Each revolving folding device is provided with two pockets for receiving the products and with one sheet of wrapping material, said pockets being diametrically opposed in relation to the axis of rotation of the revolving folding means. A folding means connected to the revolving device initiates the folding of the wrapping material during the rotation of the revolving device, and an ejector, also mounted on a revolving device and rotating with it, ejects the wrapped products onto a conveyor belt which takes them to the various stations which will complete the wrapping of the products.

The lateral folders and the ejector are mounted on the revolving device and caused to be rotated along with it during each work cycle. Because of the mass of this system, the considerable inertia of the apparatus limits its rhythm.

Furthermore, during each cycle, the revolving device must effect a 180° rotation to position one of its pockets for receiving the group of products to be wrapped in wrapping material and the other pocket in position for ejecting the at least partially wrapped pockets. This necessarily diminishes the machine's speed.

The present invention proposes to remedy the disadvantages above-described by the realization of a wrapping machine for products grouped in a common package, capable of working at very high speed.

According to the invention there is provided a wrapping machine, for products grouped inside a common package, comprising a device for feeding wrapping material, means for transporting groups of products, receptor means disposed to simultaneously receive at least one section of wrapping material of a predetermined length, and ejector means to eject the product at least partially wrapped in said material, wherein the receptor means and the transporting means consist of a hollow rotating cylinder, the surface of which is provided with at least one opening for receiving a group of products and a corresponding section of wrapping material, and the ejector means consists of at least one grooved slide mounted on a stationary cylindrical block disposed in the interior of the rotating cylinder and independent thereof.

The present invention will be better understood with reference to the description, given by way of example, of a preferred embodiment thereof with reference to the attached drawings, in which.

Figure 1:
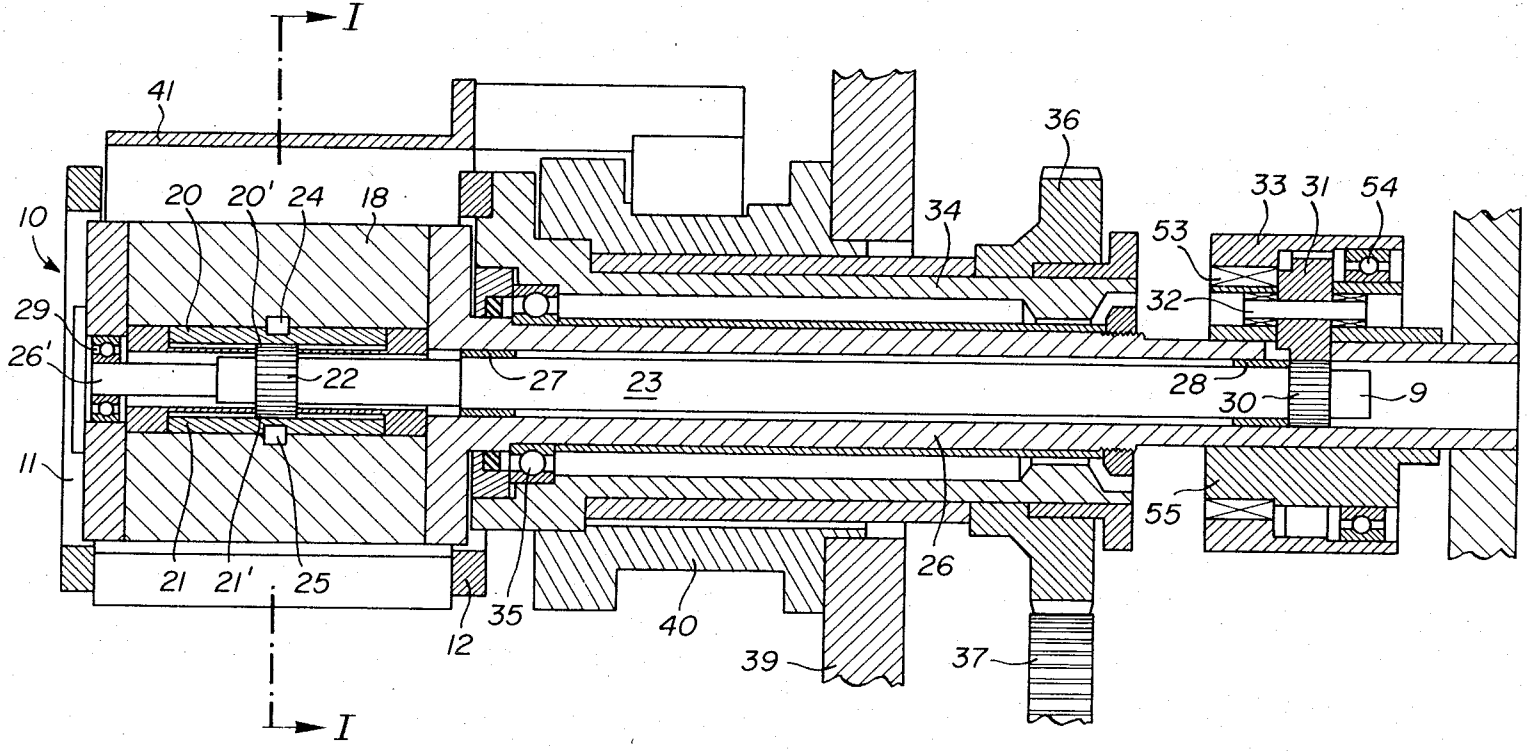
FIG. 1 is a partial longitudinal cross-section of a receptor and transfer cylinder arrangement of the invention.
Figure 2:
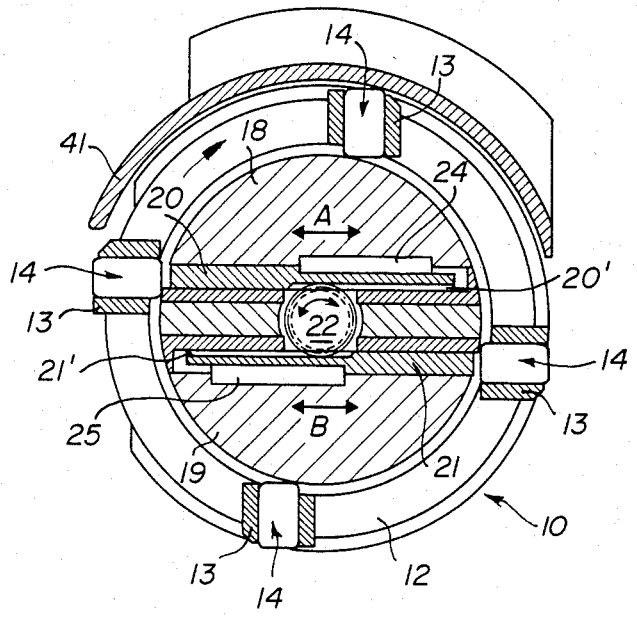
FIG. 2 is a transverse cross-section taken along line I—I of FIG. 1.
Figure 3:
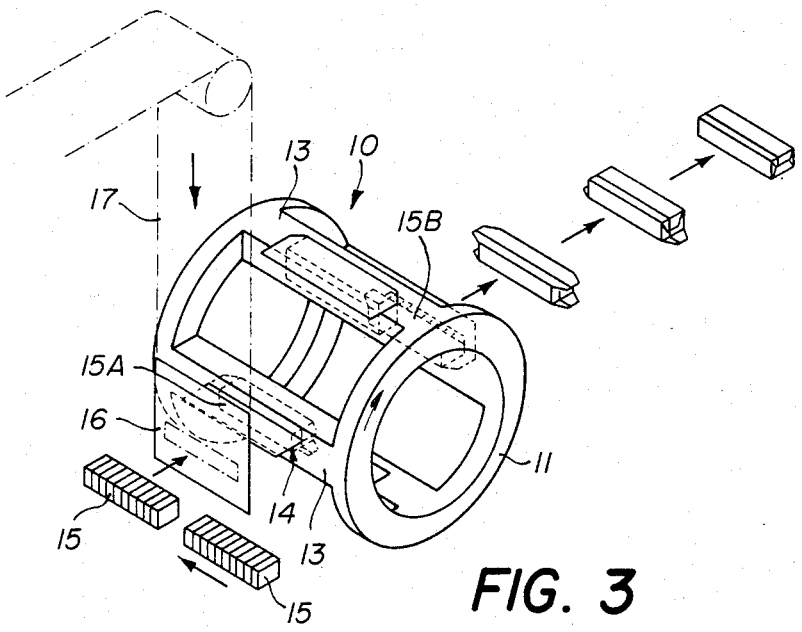
FIG. 3 is a perspective view of the rotating cylinder of the apparatus according to the invention, said view illustrating the principle of the apparatus' function.

With reference to FIGS. 1, 2 and 3, the machine described consists essentially of a hollow cylinder 10 comprised of two parallel annular supports 11 and 12, connected by four parallel transverse ribs 13, which are perpendicular to the annular supports 11 and 12. Each one of the said ribs has a transverse central opening 14 of dimensions which enable it to hold a group of products 15, for example, pieces of gum. Said groups of products 15 are introduced into the opening 14 simultaneously with a section 16 or wrapping material 17 furnished by the feeding apparatus, not shown. Once a group of products 15 has been placed in the corresponding opening 14, the folding of the section 16 of wrapping material 17 is initiated, as is shown in detail in FIG. 3.

During each work cycle, the cylinder effects a quarter turn, while the devices of the prior art with revolving folding means effect a half turn during each cycle. In the example described, the cylinder comprises four transverse ribs and four openings for folding. Nevertheless, this number is not arbitrary. The provision of four openings rather than the two openings of current revolving devices allows increased production speed. An embodiment with larger cylinders comprising more ribs and more openings would be possible.

Two complimentary blocks 18 and 19 having essentially cylindrical surfaces are mounted on the inside of the cylinder. Said blocks are stationary and their peripheral surfaces serve as a guiding surface for products 15 introduced into opening 14 during their transfer from the introductory position 15A into their ejection position 15B (see FIG. 3).

As shown in greater detail in FIGS. 1 and 2, two grooved slides 20 and 21 are mounted on the inside of the two complimentary blocks 18 and 19, one of which grooved slides 21 constitutes the means for ejecting partially wrapped products 15. These two grooved slides 20 and 21 can be simultaneously inversely displaced, in the respective directions of the double arrows A and B, to at least partially penetrate the diametrically opposed openings. To accomplish this, the grooved slides 20 and 21 comprise a central zone having the shape of a bar provided with teeth 20' and 21' designed to interlock with the teeth of the central pinion 22 mounted on a pivotable shaft 23. Two tracks 24 and 25 serve respectively as guides for the grooves 20 and 21 during their displacement.

The complimentary blocks 18 and 19 are joined with a stationary tubular piece 26, in the interior of which is mounted the pivotable shaft 23, fixed in place by means of bearings 27 and 28 and whose extension 26', of reduced section, is held in place by a ball bearing 29.

Free end 9 of the pivotable shaft 23 holds a pinion 30 which meshes with a gear 31 having a fixed axis, itself gripped by the tooth of an interiorly toothed rim 33, driven by alternative rotation by means of a mechanism which will be described in greater detail with reference to FIG. 4.

Stationary tubular piece 26 is itself contained in the central bore of a hollow shaft 34 mounted on ball bearings 35, and whose extremity opposite cylinder 10 has a toothed rim 36 held in place by a drive pinion 37. Said pinion, mounted on the principal shaft 38 (see FIG. 4), ensures the stepping drive of cylinder 10, i.e., its 90° rotation during each work cycle.

A bearing 40 joined to a support 39 holds hollow shaft 34. On this bearing is mounted a surface 41 for folding which ensures the folding of the upper flap of the section of wrapping material when the products are introduced in the folding opening.

Figure 4:
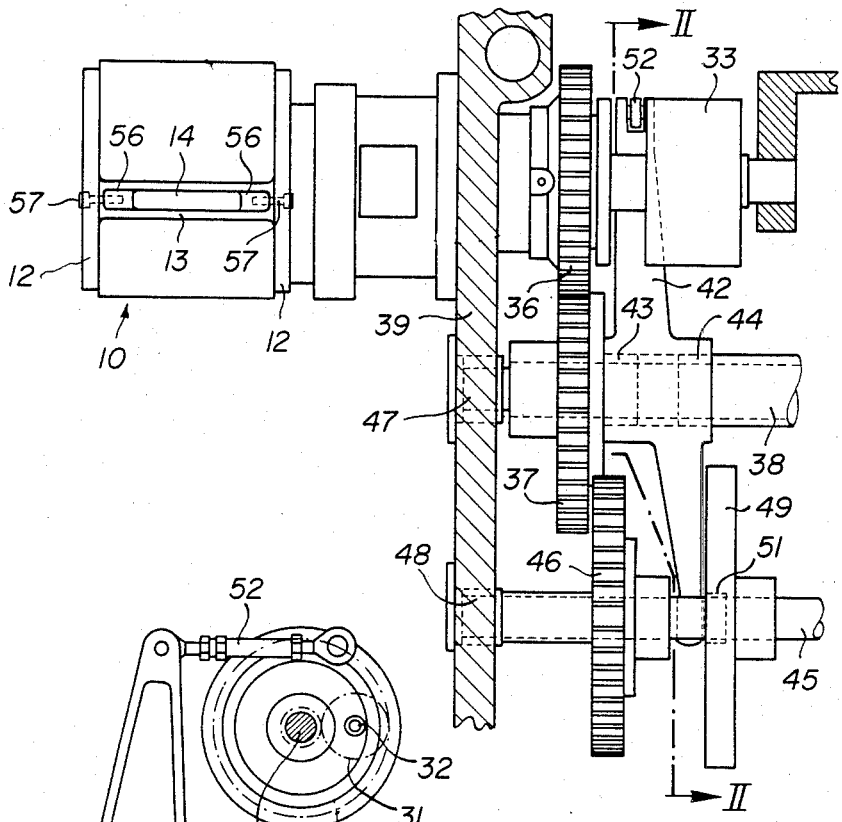
FIG. 4 is a vertical cross-section of the drive mechanism of the cylinder and of ejectors.
Figure 5:
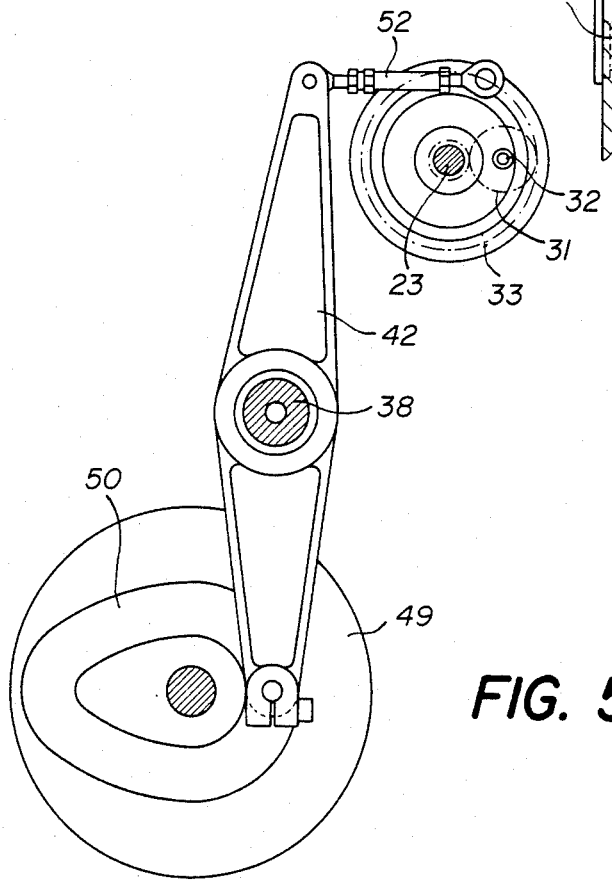
FIG. 5 is a partial transverse cross-section taken along line II—II of FIG. 4.

FIGS. 4 and 5 illustrate in greater detail the drive mechanism of the cylinder and of the ejectors of the apparatus. On principal axis 38 a pivotable lever 42 is loosely mounted. This axis holds the drive pinion 37 which causes the rotation of hollow shaft 34 upon intervention of the toothed rim 36. Said lever mounted on supports 43, 44 can rotate freely about principal axis 38, held by one of its extremities to support 39 by a ball bearing 47 and at its other extremity by an indexing mechanism (not shown).

A secondary axis 45, driven by a toothed pinion 46 which meshes with a gear (not shown) and mounted on support 39 by bearing 48, contains a cam 49 in which there is a V-shaped passageway 50 (see FIG. 5) formed in the side of the disk constituting cam 49 and into which a roller 51 is introduced, connected at one extremity to the pivotable lever 42. This device causes the alternating pivoting movement of said lever, which will be transformed, in a manner described in greater detail hereinafter, into alternating movement with pivotable shaft 23. The upper extremity of lever 42 is connected to toothed rim 33 by a pulley 52, which, as shown in FIG. 1, is mounted by means of the bearings 53 and ball bearings 54 on a cylindrical support 55 joined to stationary tubular piece 26, the latter being used to support both the gear 31 and the fixed axis 32.

The alternating pivoting movement of lever 42 around principal axis 38 reacts with toothed rim 33 which turns alternatively in one direction and the other, while driving pinion 31 which in turn acts on pinion 30 connected with pivotable shaft 23. As described with reference to FIG. 1, this action initiates the lateral motion of grooved slides 20 and 21.

FIG. 4, viewed from above, shows an opening 14 in a transverse rib 13 joining annular supports 11 and 12 of cylinder 10. To allow adaptation of the openings to groups of products of different lengths, plugs 56, affixed to annular supports 11 and 12 by means of screws 57, are provided. These plugs are interchangeable so that the length of the openings can be adapted to that of the groups of products to be dealt with.

The cylinder is preferably made of one piece of a light alloy so that the mass of the rotating section of each cycle is reduced as much as possible. This measure contributes to increased production speed.

I claim:

1. A wrapping machine, for products to be grouped inside a common package, comprising a machine support, a device for feeding wrapping material, means for transporting groups of products, receptor means disposed to simultaneously receive at least one section of wrapping material of a predetermined length, ejector means to eject the product at least partially wrapped in said material, and a drive means, for the cylinder, with a hollow shaft, said hollow shaft containing a tubular piece affixed to the machine's support and connected to the stationary cylindrical block disposed inside the cylinder, wherein:

the receptor means and the transporting means consist of a hollow rotatable cylinder, the periphery of which is provided with openings each extending through to the interior of the cylinder for receiving and transporting a group of products and a corresponding section of wrapping material, a stationary cylindrical block disposed in the interior of the rotation cylinder to provide a guide surface defining a radially inward base for each said opening to guide said products and wrapping material;

the ejector means consists of at least one grooved slide mounted on said stationary cylindrical block;

the stationary cylindrical block has at least one opening disposed to house a said grooved slide which can be laterally displaced; and the grooved slide is equipped with a bar which engages a toothed pinion connected to a rotatable shaft within said hollow shaft, said rotatable shaft being connected to a cam-driven mechanism for periodically laterally displacing the grooved slide.

2. A wrapping machine according to claim 1, wherein the cylindrical block comprises two said openings disposed to contain two said grooved slides capable of being simultaneously laterally displaced in opposite directions, one of said grooved slides constituting said ejector means for products partially wrapped inside a said opening, and the other slide constituting a receptor means for said products once they have been introduced into a said opening.

3. A wrapping machine according to claim 1, wherein the cam-driven mechanism comprises a lever pivoting about a fixed axis, one extremity of which is connected to the drive cam and the other extremity of which acts, by way of an interiorly toothed annulus and a planetary gear with a fixed axis, on said toothed pinion connected to the pivotable shaft.

4. A wrapping machine, for products to be grouped inside a common package, comprising a machine support, a device for feeding wrapping material, means for transporting groups of products, receptor means disposed to simultaneously receive at least one section of wrapping material of a predetermined length, drive means for said receptor means and ejector means to eject the product at least partially wrapped in said material, wherein:

the receptor means and the transporting means consist of a hollow rotatable cylinder, the periphery of which is provided with openings each extending through to the interior of the cylinder for receiving and transporting a group of products and a corresponding section of wrapping material, the cylinder having two parallel annular supports connected by parallel transverse ribs which are perpendicular to the annular supports, and the openings are disposed one in each of the transverse ribs, a stationary cylindrical block disposed in the interior of the rotation cylinder to provide a guide surface defining a radially inward base for each said opening to guide said products and wrapping material;

the ejector means consists of at least one grooved slide mounted on said stationary cylindrical block;

said drive means has a hollow shaft, said hollow shaft containing a tubular piece affixed to the machine's support and connected to the stationary cylindrical block disposed inside the cylinder;

said stationary cylindrical block has at least one opening disposed to contain a said grooved slide which can be laterally displaced;

the grooved slide is equipped with a bar which engages a toothed pinion connected to a rotatable shaft within said hollow shaft, said rotatable shaft being connected to a cam-driven mechanism for periodically laterally displacing the grooved slide; and the cam-driven mechanism comprises a lever pivoting about a fixed axis, one extremity of which is connected to the drive cam and the other extremity of which acts, by way of an interiorly toothed annulus and a planetary gear with a fixed axis, on said toothed pinion connected to the rotatable shaft.

* * * * *